US009714539B2

(12) United States Patent
Bohlen

(10) Patent No.: US 9,714,539 B2
(45) Date of Patent: Jul. 25, 2017

(54) WINDING SHAFT DRIVE FOR OPERATING A RETRACTABLE ARCHITECTURAL COVERING AND SHAFT BRAKE MODULE FOR USE THEREIN

(75) Inventor: Jorg Bohlen, Langen (DE)

(73) Assignee: Hunter Douglas Industries BV, Rotterdam (NL)

( * ) Notice: Subject to any disclaimer, the term of this patent is extended or adjusted under 35 U.S.C. 154(b) by 145 days.

(21) Appl. No.: 13/978,353

(22) PCT Filed: Jan. 5, 2012

(86) PCT No.: PCT/EP2012/000037
§ 371 (c)(1),
(2), (4) Date: Oct. 1, 2013

(87) PCT Pub. No.: WO2012/093089
PCT Pub. Date: Jul. 12, 2012

(65) Prior Publication Data

US 2014/0014280 A1 Jan. 16, 2014

(30) Foreign Application Priority Data

Jan. 6, 2011 (EP) ..... 11000065

(51) Int. Cl.
*E06B 9/78* (2006.01)
*E06B 9/42* (2006.01)

(52) U.S. Cl.
CPC ..... *E06B 9/42* (2013.01); *E06B 9/78* (2013.01); *E06B 2009/785* (2013.01)

(58) Field of Classification Search
CPC ..... E06B 9/78; E06B 9/80; E06B 9/84; E06B 9/88; E06B 9/90; E06B 2009/905; E06B 9/42; E06B 2009/785160/321, 323, 324, 325, 326, 307, 308, 160/291, 292
See application file for complete search history.

(56) References Cited

U.S. PATENT DOCUMENTS 4,270,720 A * 6/1981 Fukuchi ..... A47H 1/142 248/257
4,372,432 A * 2/1983 Waine ..... E06B 9/78 160/307

(Continued)

FOREIGN PATENT DOCUMENTS

CH 655544 A5 4/1986
EP 0096664 A2 12/1983

(Continued)

OTHER PUBLICATIONS

Great Britain Patent Application No. 0700967.3 entitled Window Coverings, filed on Jan. 18, 2007, applicant Louver-Life Limited, 24 pages.

*Primary Examiner* — Blair M Johnson
(74) *Attorney, Agent, or Firm* — Dority & Manning, P.A.

(57) ABSTRACT

A winding shaft drive (1, 1A, 101, 101A, 102, 102A) is arranged for operating a retractable covering for an architectural opening. The winding shaft drive includes an at least partially hollow winding shaft (7); a driving member (3, 103) for inducing rotation to the winding shaft; and a shaft brake adapted to be operated by the driving member. The shaft brake includes a preassembled module (5) for accommodation in the at least partially hollow winding shaft (7) and has first coupling means (67) on one axial end thereof for transmitting rotative forces and second coupling means (69) on the same one axial end for transmitting non-rotative stationary forces. The driving member has a driving hub (11, 111) for removably coupling to the first coupling means (67) and a stationary connector (17, 17A, 117, 117A) for removably coupling to the second coupling means (69). A shaft brake module (5) and a driving member (3, 103) are specifically adapted for use in the winding shaft drive.

35 Claims, 16 Drawing Sheets

(56) References Cited

U.S. PATENT DOCUMENTS

| | | | | |
|---|---|---|---|---|
| 4,534,396 | A | 8/1985 | Jung | |
| 4,884,618 | A * | 12/1989 | Steeves | 160/321 |
| 5,117,893 | A | 6/1992 | Morrison et al. | |
| 5,435,539 | A * | 7/1995 | Namiki | 271/114 |
| 5,586,631 | A * | 12/1996 | Benthin | E06B 9/90 160/297 |
| 7,147,030 | B2 | 12/2006 | Dalle Nogare et al. | |
| 7,497,242 | B2 | 3/2009 | Wang | |
| 8,695,681 | B2 * | 4/2014 | Daniels | E06B 9/50 160/291 |
| 8,893,766 | B2 * | 11/2014 | Bohlen | 160/323.1 |
| 2007/0107857 | A1 * | 5/2007 | Wang | E06B 9/42 160/321 |
| 2008/0121353 | A1 * | 5/2008 | Detmer et al. | 160/266 |
| 2008/0173499 | A1 | 7/2008 | Allsopp | |
| 2014/0014280 | A1 * | 1/2014 | Bohlen | 160/291 |

FOREIGN PATENT DOCUMENTS

| | | | |
|---|---|---|---|
| EP | 1936107 | A2 | 6/2006 |
| EP | 1865142 | A1 | 12/2007 |
| EP | 1921246 | A2 | 5/2008 |
| EP | 1925773 | A1 | 5/2008 |
| EP | 1947288 | A2 | 7/2008 |
| GB | 2180872 | A | 4/1987 |
| NL | 1010642 | | 8/1999 |
| WO | 9954585 | A1 | 10/1999 |
| WO | 2009/086898 | A1 | 7/2009 |
| WO | 2010/089118 | A1 | 8/2010 |

* cited by examiner

WINDING SHAFT DRIVE FOR OPERATING A RETRACTABLE ARCHITECTURAL COVERING AND SHAFT BRAKE MODULE FOR USE THEREIN

CROSS-REFERENCE TO RELATED APPLICATIONS

This application is the national stage application of PCT Patent Application No. PCT/EP2012/000037 filed on Jan. 5, 2012, and entitled "Winding Shaft Drive For Operating a Retractable Architectural Covering and Shaft Brake Module For Use Therein," which claims priority to European Patent Application No. 11000065.0 filed on Jan. 6, 2011, and entitled "Winding Shaft Drive For Operating a Retractable Architectural Covering and Shaft Brake Module For Use Therein," which applications are hereby incorporated by reference into the present application in their entireties.

The invention relates to a winding shaft drive for operation of a retractable covering for an architectural opening. Winding shaft drives for window coverings, where lift cords, or a flexible screening member are wound onto the winding shaft, such as in roller blinds, are generally known.

The known winding shaft drives for window coverings usually require a shaft brake to prevent the retracted screening member from returning to its extended position under its own weight. Such shaft brakes are conveniently integral with a drive member for rotating the winding shaft. Because window coverings come in various sizes, to cover relatively small architectural openings, as well as relatively large architectural openings. The required shaft brake force increases with the size of the window covering and it has often been necessary to provide drive members with differently sized shaft brakes, to enable the offering of an adequate range of window coverings. For reasons of stock keeping and ease of manufacture there is a continuing demand for reducing the number of different components. Moreover accommodating the larger sizes of shaft brakes into the driving member has also encountered limits in shape and size. Further it has also become popular to use spring assistance in retractable window coverings to counter the extra weight of larger sizes, so that manual or motor driven operation is less affected by gravity. One problem with such spring assistance is that pretensioning or preloading of the spring assistance is critical and difficult to adjust by the installer. One example of the prior art is described in U.S. Pat. No. 7,497,242.

Accordingly it is an object of the present invention to propose an improved driving mechanism for a winding shaft of an architectural covering. In a more general sense it is thus an object of the invention to overcome or ameliorate at least one of the disadvantages of the prior art. It is also an object of the present invention to provide alternative structures which are less cumbersome in assembly and operation and which moreover can be made relatively inexpensively. Alternatively it is also an object of the invention to at least provide the public with a useful choice.

To this end the invention provides a driving mechanism for operating a winding shaft of a retractable architectural covering, or a retractable covering for an architectural opening, the winding shaft drive including: an at least partially hollow winding shaft; a driving member for inducing rotation to the winding shaft; and a shaft brake adapted to be operated by the driving member, wherein the shaft brake includes a preassembled module for accommodation in the at least partially hollow winding shaft and having first coupling means on one axial end thereof for transmitting rotative forces and second coupling means on the same one axial end for transmitting non-rotative stationary forces, and wherein the driving member has a driving hub for removably coupling to the first coupling means and a stationary connector for removably coupling to the second coupling means. When the weight of a window covering, to be operated by the winding shaft drive of the invention, exceeds the capacity of the holding force of the driving member, the shaft brake module can provide additional braking torque. By separating the shaft brake function from the driving member, with which it is conventionally associated, it also is possible to reduce the volume necessary for the driving member and thereby minimalise any light gaps at the sides of a window covering, such as roller shades.

In connection with the invention it is particularly advantageous when the shaft brake module has a stationary shaft associated with the second coupling means, and wherein an end of the stationary centre shaft is exposed at an end of the shaft brake module opposite of the second coupling means and adapted to be coupled to a connector sleeve of a spring assist module. This can moreover be very useful when the winding shaft drive is further comprising a spring assist module. In this combination the shaft brake module can be coupled with the spring assist module. When the spring assist module and the shaft brake module are preassembled into the at least partly hollow winding shaft, then the spring assist module can be pretensioned or preloaded. The pretension or preload of the spring assist module will then be conveniently maintained by the shaft brake module. The end user or window covering installer thereby do not have to worry about any adjustment op the spring assist module prior to use, as these adjustments can be factory set.

It is further preferred that the shaft brake module includes any one of a selected number of wrap springs acting as a braking element. In the embodiment that will be described up to four wrap springs can be mounted on an inner brake sleeve. In this regard it is further preferred that the inner brake sleeve, for frictional engagement by the or each wrap spring, has a lubrication groove helically wound about an outer friction surface thereof. To prevent noise and wear, lubrication grease is conventionally used in wrap spring brakes. As a result of the substantially flat contact surfaces created by square section spring wire cross section and smooth outer surfaces of the inner brake sleeve, the distribution of the lubrication grease has at times been somewhat erratic, resulting in creaking noises already after a few operating cycles. The provision of this helical lubrication groove has significantly improved the distribution of lubrication grease, with no noticeable effect on the effectiveness of the friction surface itself.

In a further preferred arrangement the shaft brake module and the driving member can be coupled to one another in a plurality of relative rotational positions by predefined increments. This can advantageously be achieved when the first coupling means include internal splines on the shaft brake module for coupling with corresponding splines on the driving hub. Similarly the second coupling means can include a splined end section on a stationary centre shaft for coupling with corresponding splines on the stationary connector. To connect the shaft brake module and the driving member, these parts may thereby be mated together in a plurality of different relative positions. This may in particularly be helpful when the driving member has defined end positions, as is often the case.

Further it is advantageous, when the first coupling means has an undercut area at an axial end adapted to face the driving hub, to allow the winding shaft to engage the driving member at an angle with respect to an aligned position in which it is finally mounted. In this regard it is also preferred when the stationary connector has a widened area for receiving the second coupling means at an angle with respect to an aligned position in which it is finally mounted. When installing or removing the winding shaft to or from an already installed driving member the undercut area and the widened area, allows the winding shaft to be presented at an angular position, so that each of its ends may be connected one after the other, rather than at the same time. This avoids putting force on the coupling elements and protect these from becoming damaged.

In one embodiment of the invention the driving member can also have itself an integral shaft brake. This arrangement is useful when the shaft brake integrated in the driving member is not sufficient for holding a particular winding shaft in position. The shaft brake module is then employed as an additional auxiliary shaft brake, to increase the holding force of the drive member. This may be necessary when the window covering to be retracted by the winding shaft exceeds the maximum dimensions for which the driving member with its integral shaft brake is designed. Also when spring assistance is desired for a particular window covering, that is to be operated by the winding shaft drive, it may be useful to employ a separate auxiliary shaft brake module in accordance with the invention. In a driving member with an integral shaft brake, an advantageous arrangement may includes a wrap spring holder ring. Use of a wrap spring holder ring greatly enhances the ease of wrap spring handling and assembly thereof in the driving member. Such a wrap spring holder ring may also advantageously have inwardly directed rims on each of its axial end faces. These inwardly directed rims exactly position the wrap spring on its braking surface and ensures that brake forces will be identical in both directions of rotation.

To minimise friction the driving member may include a ball bearing that is interposed between a housing thereof and the driving hub. It is also preferred when the driving member includes a chain wheel and an operating chain. The operating chain may optionally also include a chain stopper for defining an end of travel for the driving chain and adapted to define one of a fully retracted or fully extended positions of the winding shaft. This may make it necessary to first adjust the driving member as to the opposition of the chain stopper, before mounting of the winding shaft by means of the shaft brake module accommodated therein. When using an operating chain, the operating chain may be guided over a chain guide surface, wherein the chain guide surface is of a relatively hard and wear resistant material, and wherein the chain guide surface is relatively thin and supported on a relatively soft and resiliently flexible material for noise reduction. For wear resistance the guiding surface that will be touched by the operating chain is preferably made of a relatively hard abrasion resistant plastic. This however results in an increased noise level. Supporting the hard guiding material on a relatively soft, rubber-like plastic composition, has made it possible to silence the chain operation.

The invention also provides a shaft brake module that has one or more of the features disclosed and discussed herein. Similarly the invention also provides a driving member with one or more of the features disclosed herein.

Further advantages and preferences will be come clear from a detailed description of some exemplary embodiments, in which.

Figure 1:
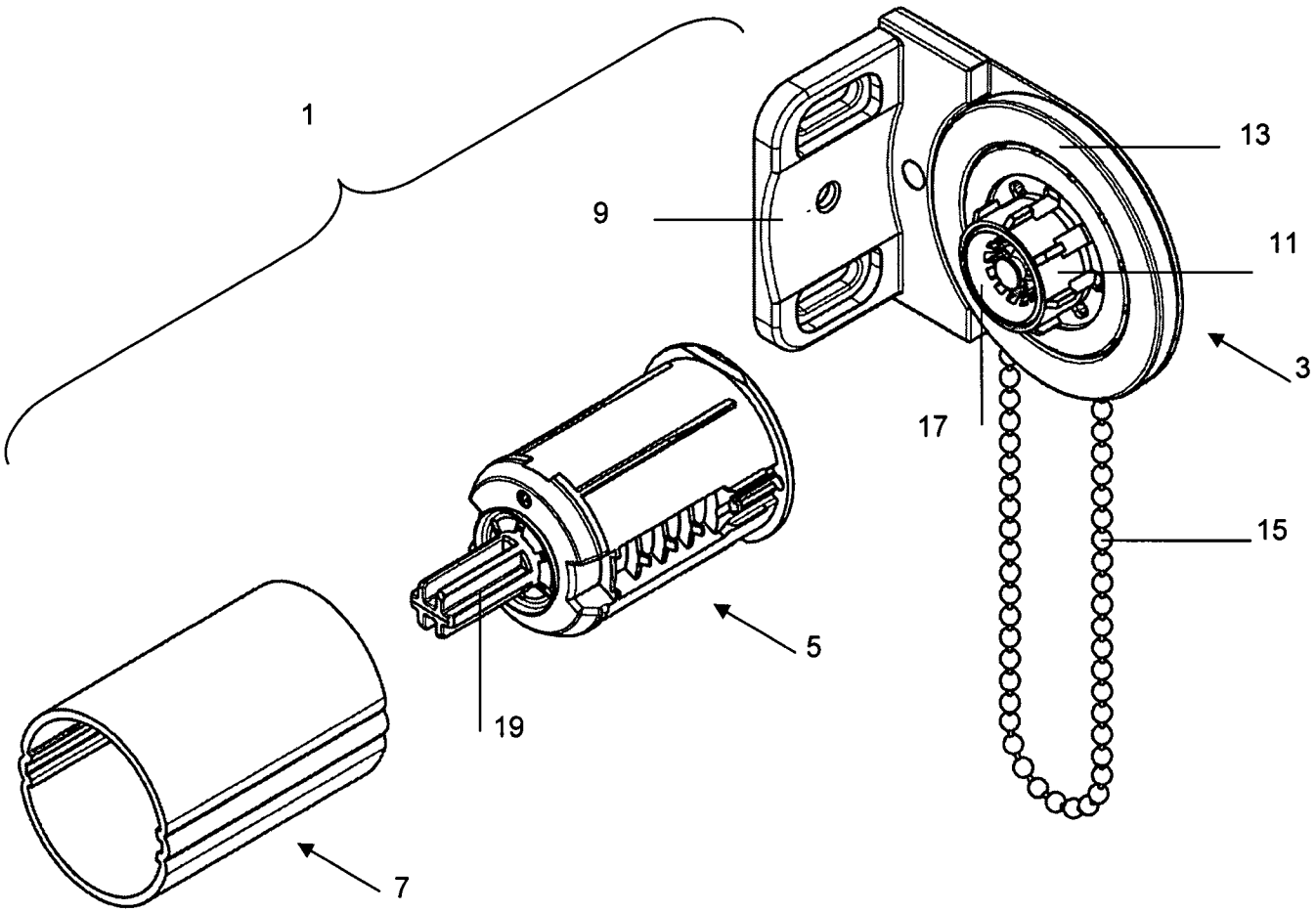
FIG. 1 shows a first embodiment of winding shaft drive according to the invention in an exploded arrangement.

In FIG. 1 an exploded arrangement is shown of a winding shaft drive 1 for operating a retractable covering for a architectural opening. Such winding shaft drives may be employed to wind lift cords of a retractable window covering, but also to wind a flexible screening member, such as in roller blinds. Winding shaft drives and their incorporation in various retractable window coverings are generally well known to the skilled person, so that the present description can be limited to the features of the winding shaft drive in as far as these differ from the prior art. The winding shaft drive 1, as shown in FIG. 1, includes a driving member 3, a shaft brake module 5 and an at least partially hollow winding shaft 7. The driving member 3 comprises a stationary bracket part 9, a driving hub 11 that can be rotated by a chain wheel, hidden from view in FIG. 1, by a swivelling chain cover 13 and is drivable by an operating chain 15. At the centre of the driving hub 11 there is a stationary connector 17 that is non-rotatably connected to the bracket part 9. As will be described below, the shaft brake module 5 has a stationary centre shaft 19 that may be connected with the stationary connector 17 of the driving member 3.

Figure 2:
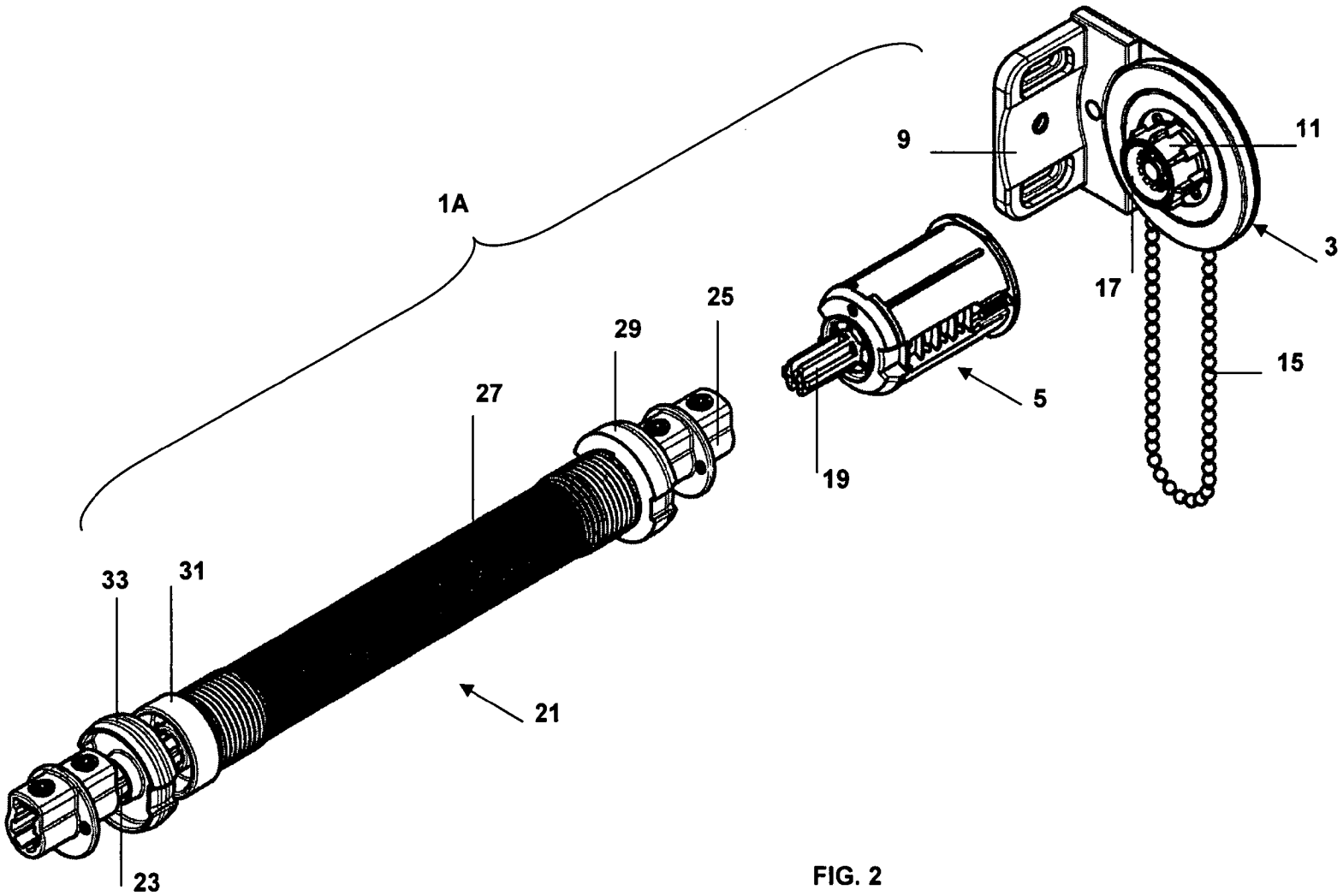
FIG. 2 is an exploded arrangement of a variation of the first embodiment having an additional spring assist module.

In FIG. 2 an exploded arrangement is shown of a variation winding shaft drive 1, but for the optional addition of a spring assist module 21. The spring assist module 21 is generally as described in applicant's published international patent application WO 2010/089118 and reference to this publication can be had for further details of the spring assist module. In as far as the present invention is concerned, it will only be mentioned that the spring assist module 21 has a centre shaft 23 that has a non-circular connector sleeve 25 on at least one longitudinal end thereof for coupling to the stationary centre shaft 19 of the shaft brake module 5. A helically wound torsion spring 27 surrounds the centre shaft 23 and one end has a coupling flange 29 for coupling to the hollow winding shaft, deleted from FIG. 2 for clarity, but identical to the winding shaft 7 in FIG. 1. An opposite end of the torsion spring 27 sits on a sleeve 31 by which it is coupled to the centre shaft 23. As will be clear from the description given in applicant's WO 2010/089118, the spring assist module 21 can be dimensioned and/or pretensioned to compensate for the weight of screening materials during extension and retraction of the winding covering by the winding shaft drive.

Figure 3:
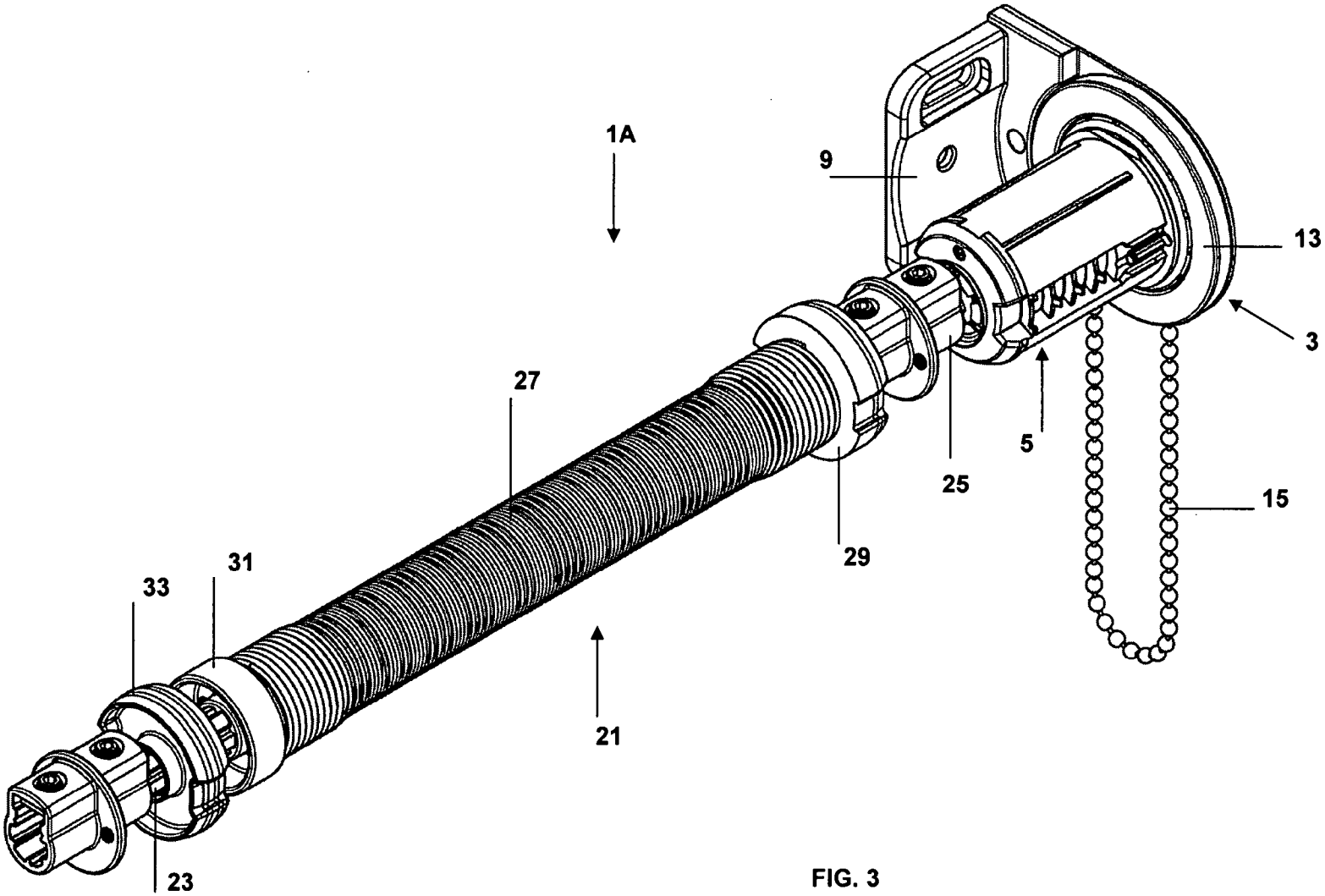
FIG. 3 shows the variation of FIG. 2 in its assembled arrangement.

FIG. 3 simply shows the components of FIG. 2 in their assembled arrangement. It is also seen that the spring assist module 21 has an idle bearing 33, which journals the stationary centre shaft 23 in respect of the winding shaft. The winding shaft, which is not shown in FIG. 3, accommodates the entire assembly of spring assist module 21 and shaft brake module 5 within its hollow interior. When the winding shaft is a roller blind roller, the fact that it can extend up to the swivelling chain cover 13 results in a very minimal light gap at the operating end of the roller blind, where the operating chain 15 depends. This advantage has been achieved by the shaft brake 5 being independent from the driving member 3.

Figure 4:
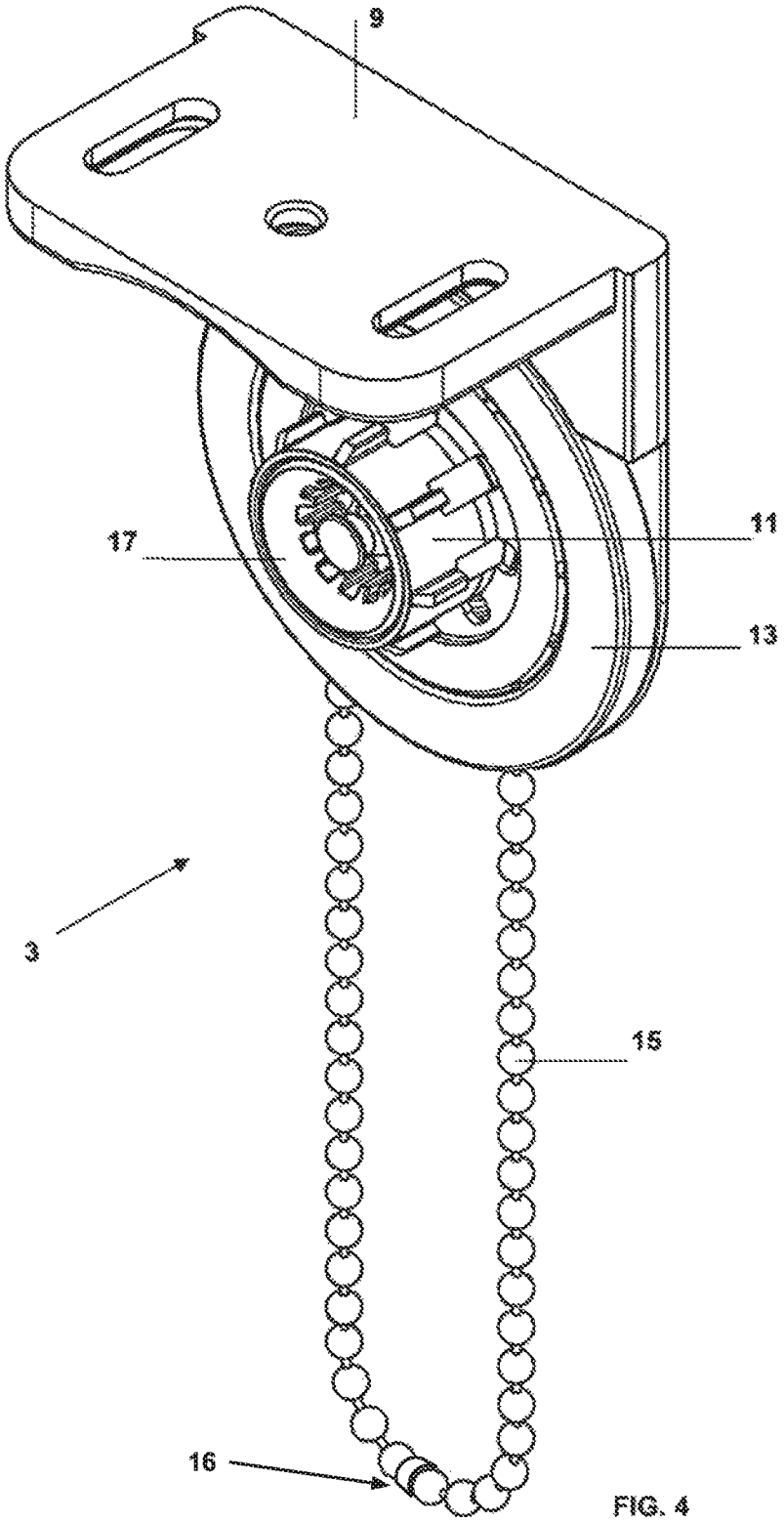
FIG. 4 is an enlarged view showing only the driving member of the first embodiment.

FIG. 4 shows the driving member 3 of the previous Figures on a somewhat enlarged scale to make it easier to recognize the various elements already described. FIG. 4 also serves to show that the swivelling chain cover 13 not only allows deflection of the loop of operating chain 15, but also to offer the option of having the bracket part 9 in a position for overhead mounting.

Figure 5:
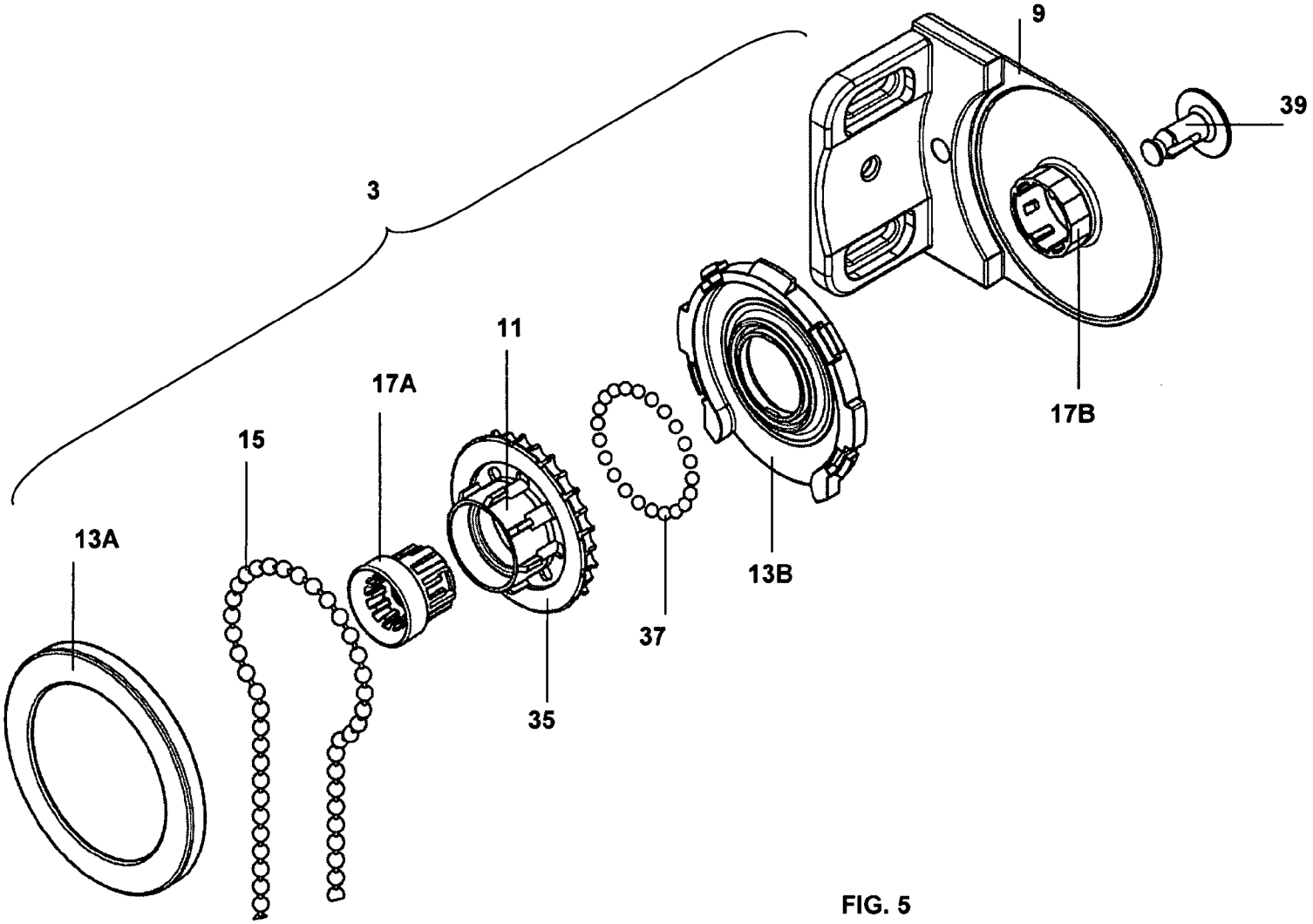
FIG. 5 is an exploded view of the driving member of FIG. 4.

FIG. 5 is an exploded view of the driving member 3 of FIG. 4. The driving hub 11 is part of a chain wheel 35. The chain wheel 35 rotates on a ball bearing 37 within the swivelling chain cover that is comprised of a cover part 13A and a base part 13B. The cover part 13A snap fits onto the base part 13B, so that the chain wheel 35, ball bearing 37 and operating chain 15 are held together on the bracket part 9 by the stationary connector 17A, being non-rotatably received in the bracket protrusion 17B and secured by connector pin 39.

Figure 6:
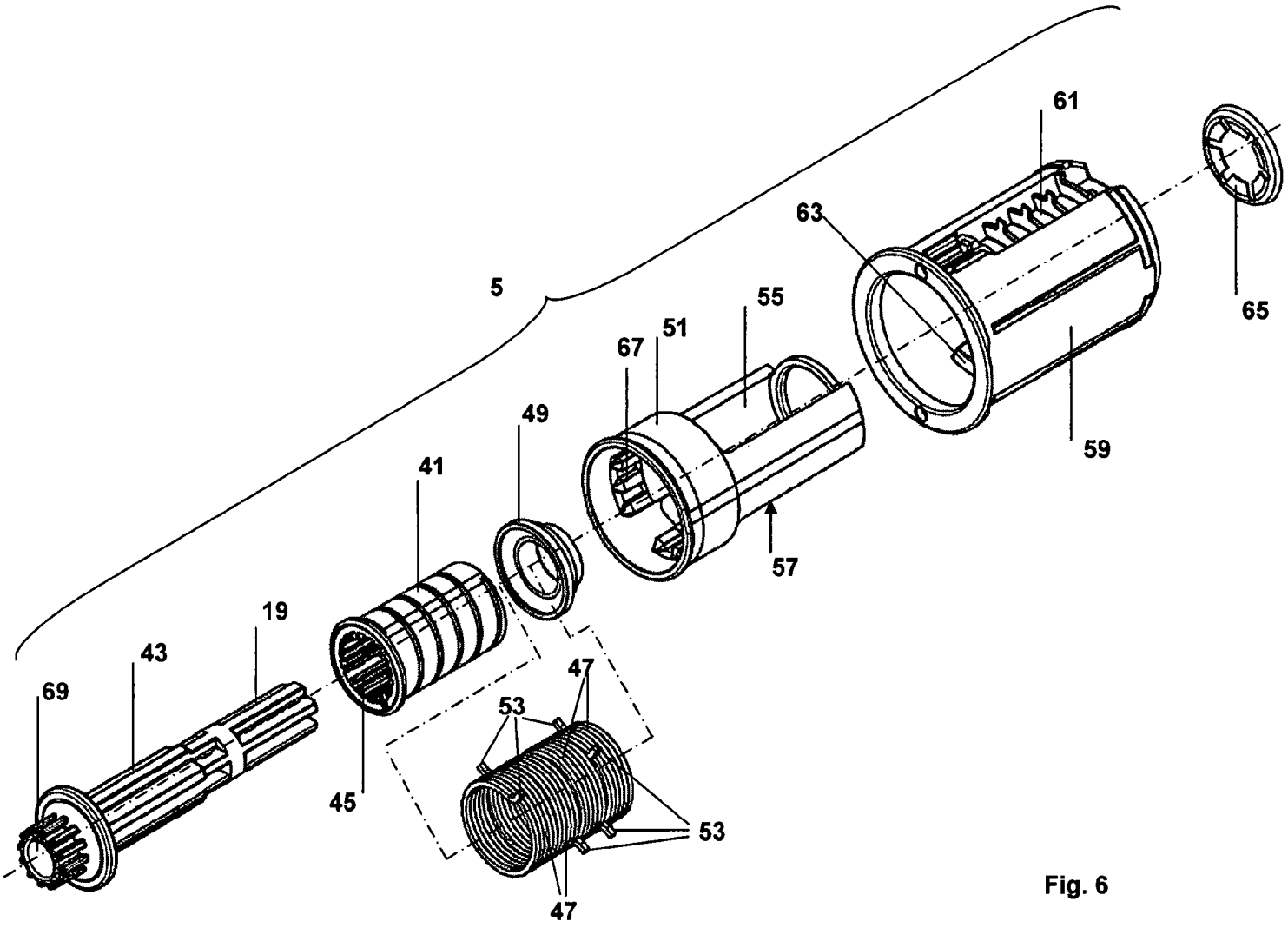
FIG. 6 is an exploded view of the auxiliary shaft brake module shown in FIGS. 1 to 3.

FIG. 6 in an exploded arrangement shows the shaft brake module 5. The shaft brake module 5 is comprised of a centre shaft 19 onto which an inner brake sleeve 41 is non-rotatably held by means of a splined exterior section 43 on the centre shaft 19 and a splined interior 45 of the inner brake sleeve 41. The brake sleeve 41 in this example can receive up to four individual wrap springs 47. The number of wrap springs 47 that will be used is a function of the required braking force, which itself depends on the size of the window covering that will be operated by the winding shaft drive. An intermediate bearing disc 49 and an outer brake sleeve 51 accommodate the brake sleeve 41 and the wrap springs 47. Wrap springs 47, which are frictionally engaging the brake sleeve 41, each have radially extending tangs 53 on their opposite ends that project through axially extending windows 55, 57 in the outer brake sleeve 51. For reasons of symmetry and balancing of forces, the outer brake sleeve 51 is provided with opposite windows 55, 57 and the spring tangs 53 of the wrap springs 47 are positioned to alternatingly being engaged by the axial edges of one window 55 or the other window 57. The skilled person will know that it is also possible to use only a single window on one side of the outer brake sleeve 51 and with all the spring tangs 53 extending between the axial edges of such a single window. Accommodating the components of the shaft brake module is an outer housing 59. The outer housing 59 has inwardly extending key formations 61, 63, which confront the respective windows 55, 57 of the outer brake sleeve 51. Reference numeral 63 is pointing at the actual key formation, while reference 61 is merely pointing at its reverse side as it appears on the exterior of the outer housing 59. Each of the key formations 61, 63 extends axially between opposite edges of the relevant windows 55, 57 and also between the spring tangs 53. For retaining the described components of the shaft brake module 5 in an assemble condition, a speed nut 65 is provided that engages the protruding centre shaft 19. Further shown in FIG. 6 is that the outer brake sleeve 51 has internal splines 67 on one end and that the centre shaft 19 has a splined end section 69. For a preliminary understanding of the working of the shaft brake module 5, it may be helpful reverting to FIG. 1. When the shaft brake module 5 is connected to the driving member 3, the internal splines 67 of the outer brake sleeve will be engaged by the driving hub 11 for rotation therewith. At the same time the splined end section 69 of the centre shaft 19 will be engaging the stationary connector 17. Rotation of the driving hub 11 by the operating chain will rotate the outer brake sleeve 51, while the inner brake sleeve 41 is kept stationary with respect to the bracket part 9. Rotation of the outer brake sleeve 51 in either of its opposite rotational directions will cause the relevant axially extending edge of the window 55, 57 to engage the relevant spring tangs 53 in a direction that opens the windings of the wrap springs 47. Thereby the wrap springs are loosened from the inner brake sleeve and allowed to rotate with the outer brake sleeve 51. Conversely when the windings shaft 7 would induce rotational forces into the outer housing 59, this would move the key formation 61, 63 to engage the relevant spring tangs 53 in a direction that increases the grip of the wrap springs 47 on the inner brake sleeve 41. Thereby any unwanted movement of the window covering's screening material from an adjusted position is effectively arrested. While the embodiment of a shaft brake module described as an example uses one or more wrap springs as a braking element, the skilled person will be aware of alternative mechanisms that can be used instead. In particular it would be possible to replace the wrap springs by a mechanism using wedges or like clamping elements.

Figure 7A:
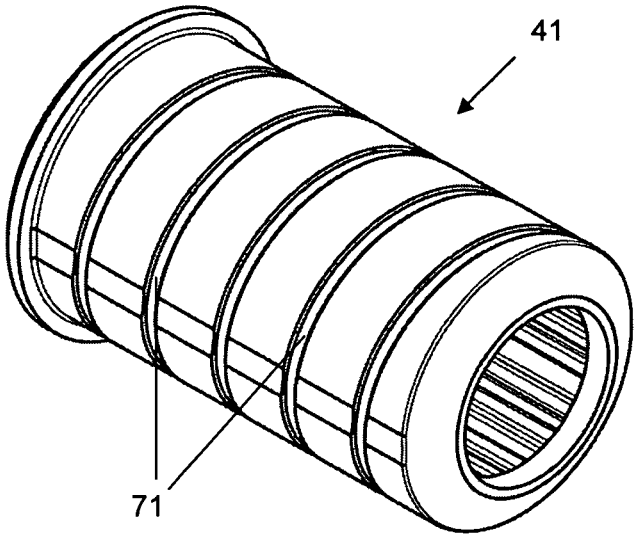
FIGS. 7A and 7B are different perspective views of the brake sleeve used in the auxiliary shaft brake module of FIG. 6.
Figure 7B:
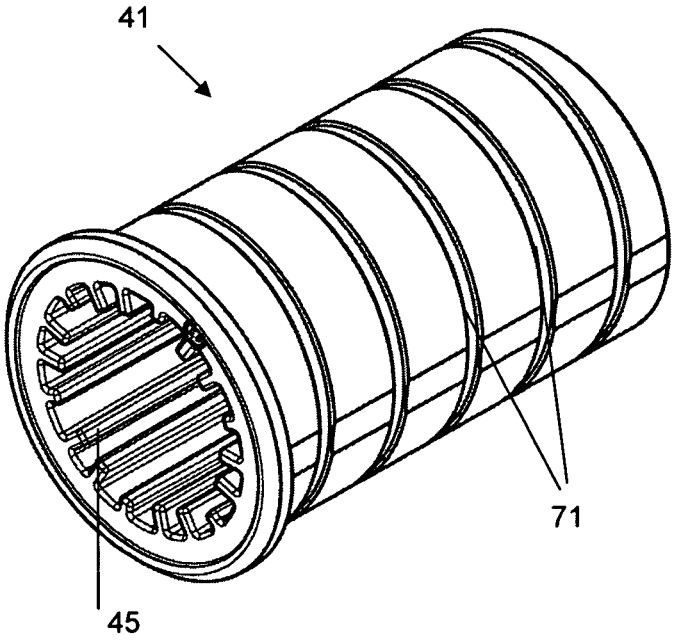

A further aspect of the inner brake sleeve 41 will now be explained in reference to FIGS. 7A and 7B. The cylindrical outer surface of the inner brake sleeve 41 is provided with a helical groove 71 extending thereabout. This groove 71 provides the wrap springs when seated on the inner brake sleeve 41 with lubrication grease. To prevent noise and wear, lubrication grease is used in wrap spring brakes, but as a result of the substantially flat contact surfaces created by square section spring wire cross section and smooth outer surfaces of the inner brake sleeve, the distribution of the lubrication grease has been somewhat erratic. The provision of the helical lubrication groove 71 significantly improves the distribution of lubrication grease, with no noticeable effect on the friction surface.

Figure 8:
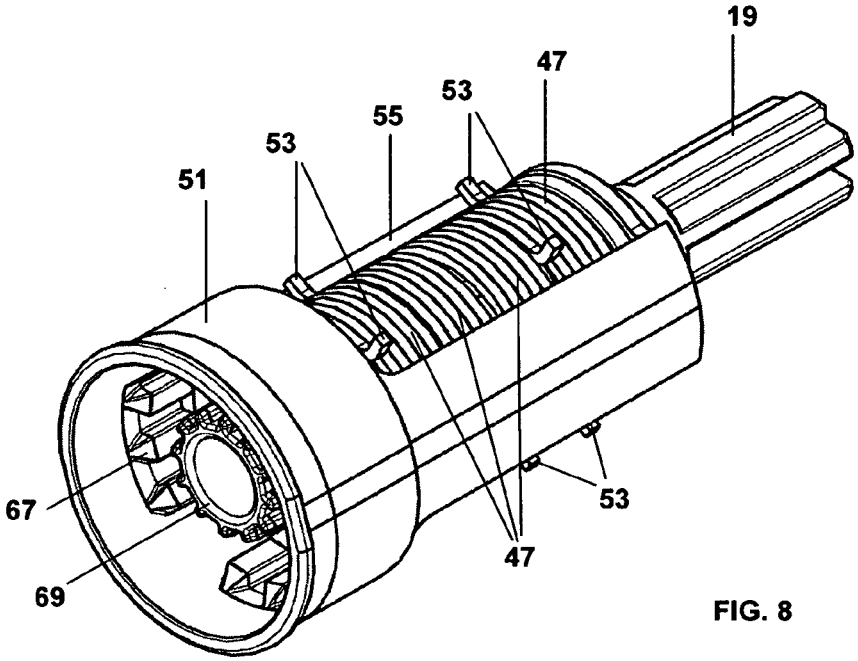
FIG. 8 is a partly assembled auxiliary shaft brake module of FIG. 6.

FIG. 8 is an additional showing of the partly assembled shaft brake module, before the outer housing is mounted. From FIG. 8 it is clear how the spring tangs 53 of the wrap springs 47 occupy the axially extending windows in the outer spring sleeve 51. Further, FIG. 8 helps to illustrate how the internal splines 67 and the splined end section 69 of the centre shaft 19 are exposed on one end for engagement with the driving hub 11 and stationary connector 17 of the driving member 3.

Figure 9A:
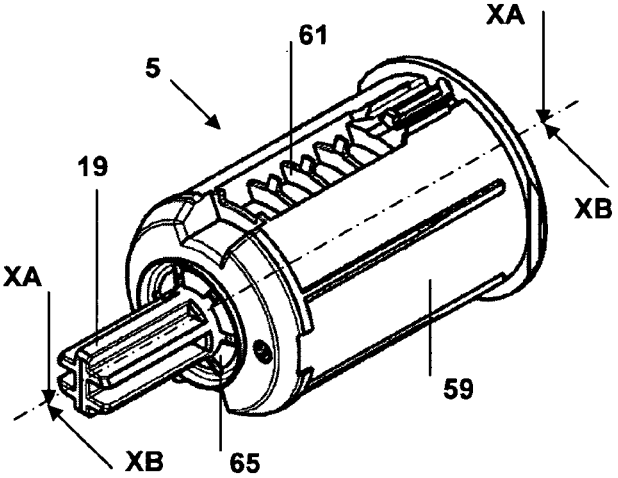
FIGS. 9A and 9B are different perspective views of the fully assembled shaft brake module of FIG. 6.
Figure 9B:
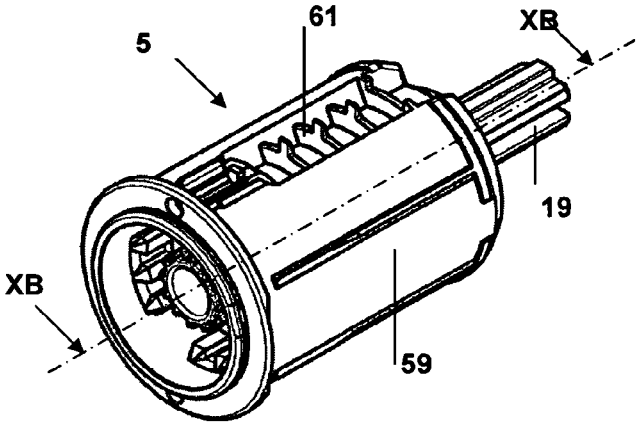
Figure 10A:
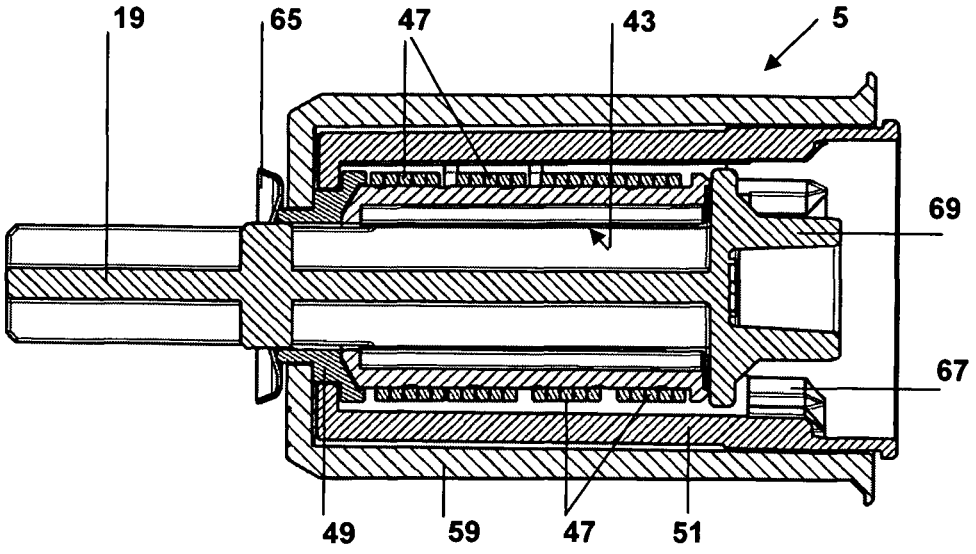
FIGS. 10A and 10B are cross sections in the directions of the arrows XA and XB in FIGS. 9A and 9B.
Figure 10B:
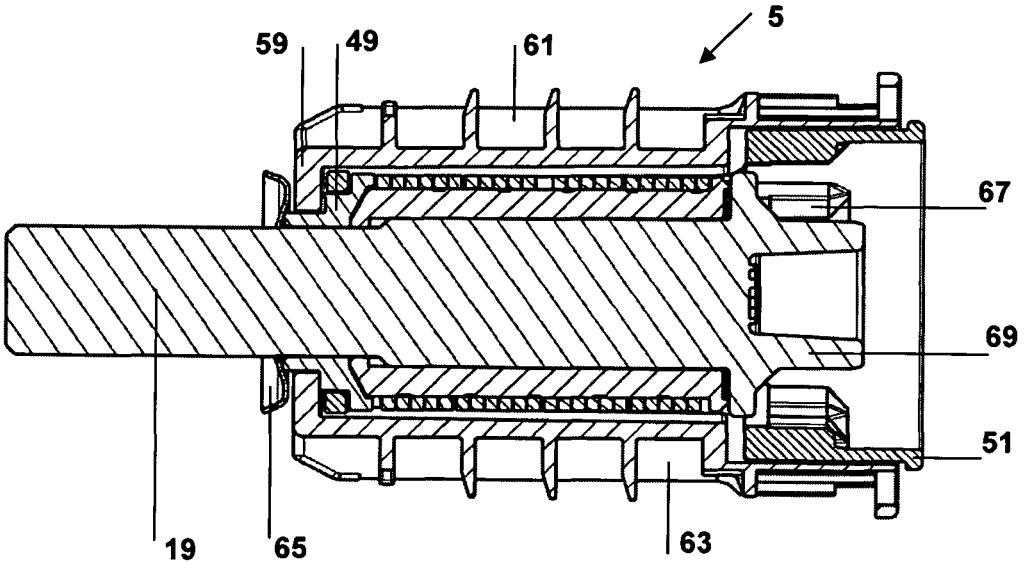

FIGS. 9*a* and 9B show opposite isometric views of the assembled shaft brake module 5. Indicated by arrows XA is the direction of the cross section shown in FIG. 10A and indicated by arrows XB the direction of the cross section shown in FIG. 10B. The reference numerals used in FIGS. 8 through 10B have already been described in reference to FIG. 6, so that repetition of such a description in relation to FIGS. 8 through 10B is deemed redundant.

In FIGS. 11 to 18 a further embodiment of winding shaft drive according to the invention will be described. Additionally, FIG. 19 shows one further variation of that embodiment. Reference numerals used in these Figures will be identical to those used in FIGS. 1 to 10B for identical components. Similar components will be labelled by reference numerals differing a full "100" from those used in FIGS. 1 to 10B.

Figure 11:
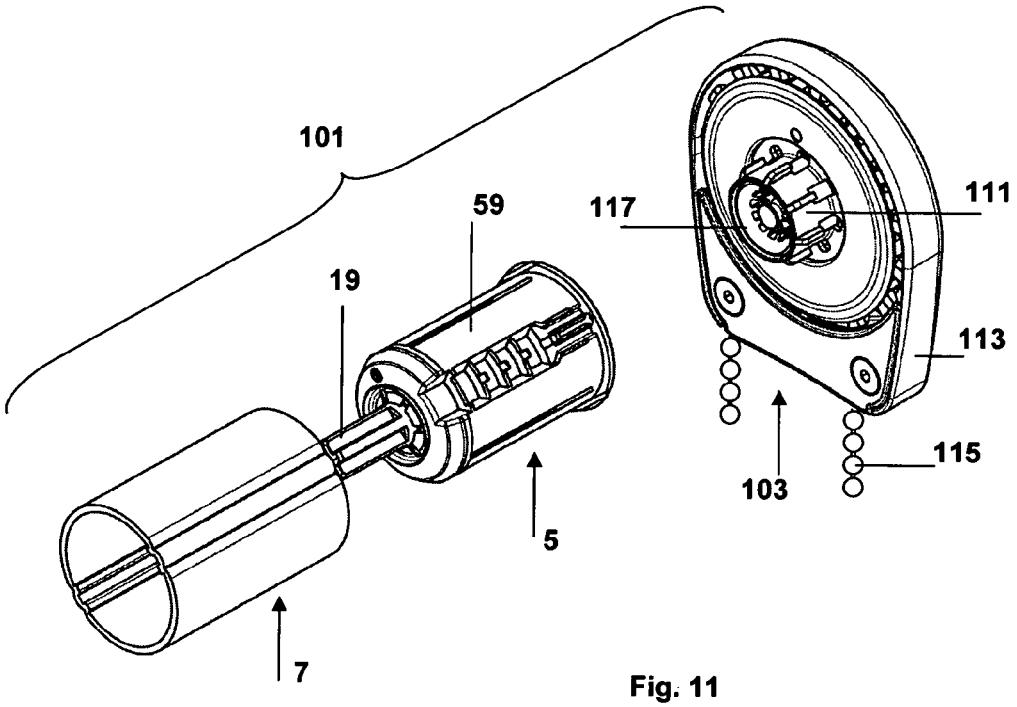
FIG. 11 is a second embodiment of winding shaft drive according to the invention.
Figure 12:
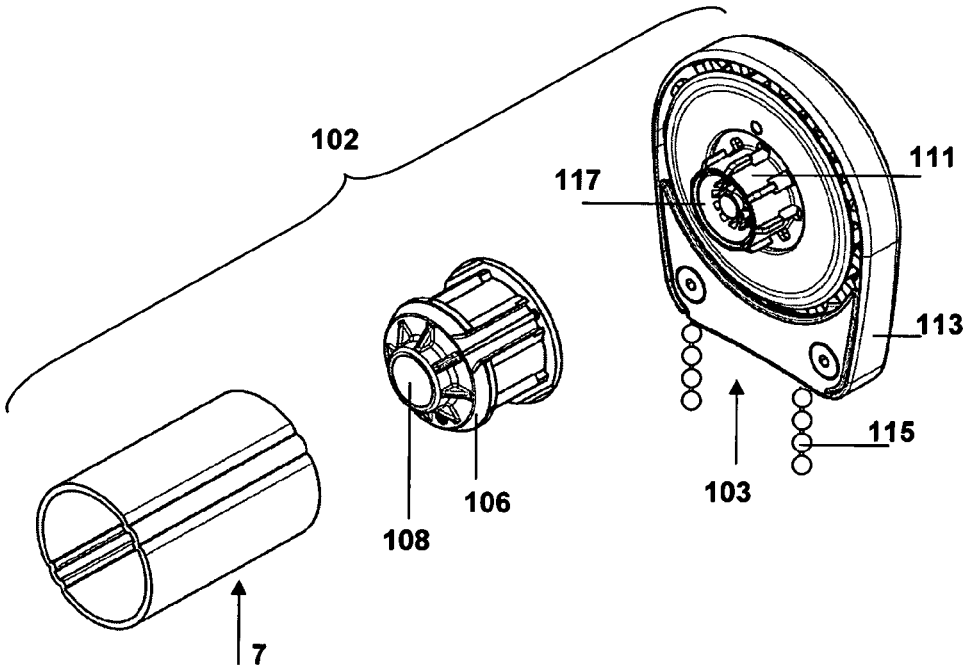
FIG. 12 is a winding shaft drive similar to FIG. 11, in which the auxiliary shaft brake is replaced by a standard shaft adapter.

Referring first to FIG. 11, there is shown an alternative winding shaft drive 101 that differs from the winding shaft drive 1 of FIG. 1 by having a different driving member 103. The driving member 103 includes a driving hub 111, a chain cover 113 and a stationary connector 117. As will be explained below, the driving member 103 has a shaft brake mechanism incorporated therein. As shown in FIG. 12, the driving member 103 can therefore also optionally be directly coupled to the winding shaft 7, by means of standard shaft adapter 106, to form a winding shaft drive 102. The standard shaft adapter 106 is here provided with a central opening 108 that communicates with the stationary connector 117 of the driving member 103 for a purpose described below. In the winding shaft drive assembly 101 according to FIG. 11, the shaft brake module 5 is employed as an additional auxiliary shaft brake, to enable the holding force of the drive member 103 to be increased. This may be necessary when the window covering to be retracted by the winding shaft exceeds the maximum dimensions for which the shaft brake included in the driving member 103 is designed.

Figure 13:
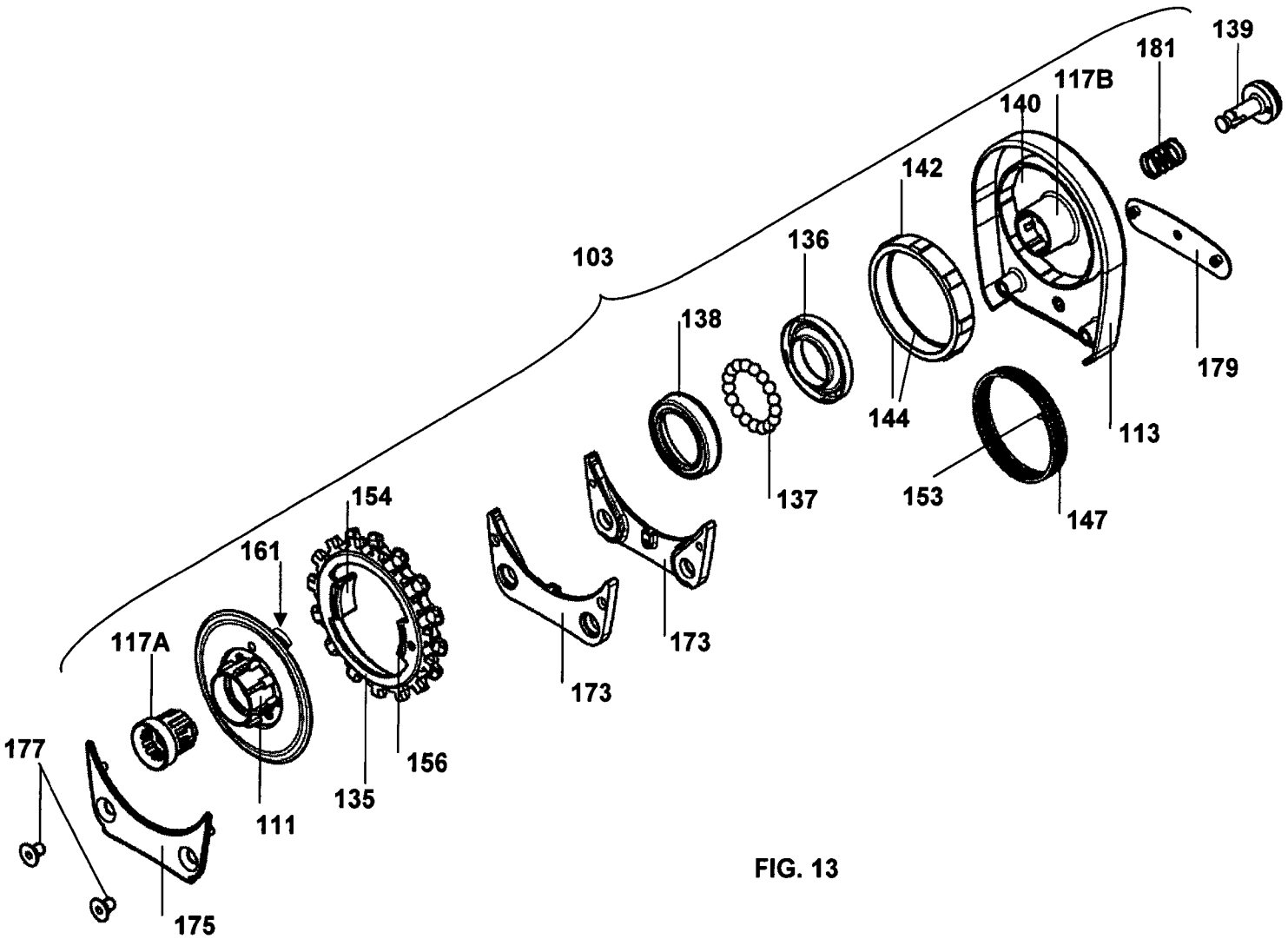
FIG. 13 is an exploded view of the driving member shown in FIGS. 11 and 12.
Figure 14:
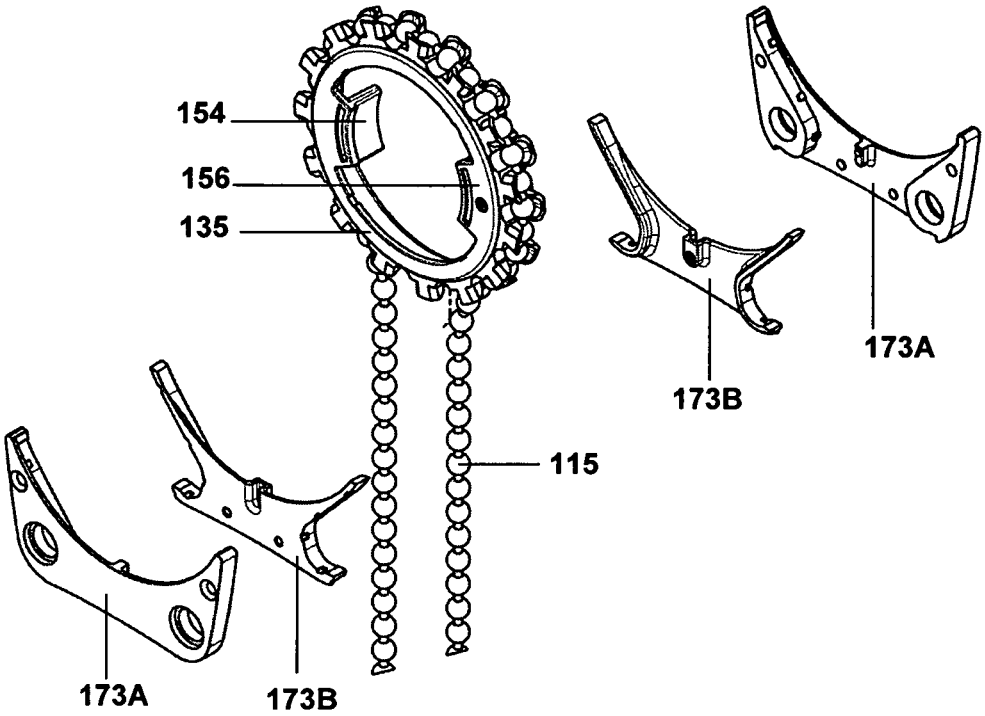
FIG. 14 is a partially exploded view of the operating chain and low noise chain guide.
Figure 15:
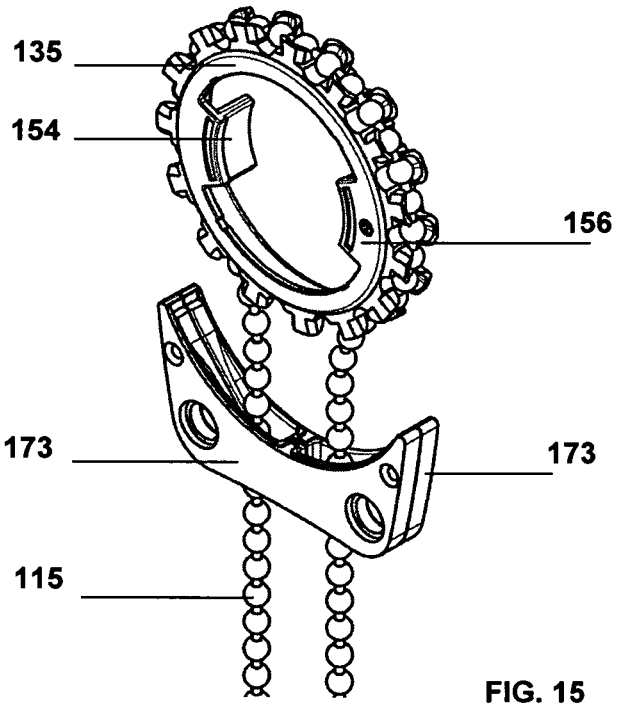
FIG. 15 is partially assembled representation of the components of FIG. 14.

Reference to FIG. 13 will explain the differences of the driving member 103 and its integral shaft brake. As shown in FIG. 13, the driving member 103 is assembled using the chain cover 113 as a basis. The chain cover 113 is provided with a protrusion 117B that receives connector 117A in a non-rotatable manner. The chain cover 113 is further provided with a shaft brake cavity 140 for receiving wrap spring holder ring 142. The outer periphery of the holder ring 142 and the inner periphery of the shaft brake cavity 140 have mating cavities and projections, so that the holder ring 142 is non-rotatably received in the cavity 140. The holder ring 142 has inwardly directed rims 144 on each of its axial ends to hold an outwardly expanding wrap spring 147 there between. The wrap spring 147 is frictionally engaging the holder ring 142 and can be premounted therein for ease of assembly. The wrap spring 147 has inwardly directed tangs 153 on its opposite ends of which one is visible in FIG. 13. The driving hub 111 has an axially extending key 161 that engages between two fingers 154, 156 on a chain wheel 135 that are complementary to the key 161. The inwardly directed tangs 153 upon assembly are occupying the respective free spaces between the axially extending key 161 and the complementary fingers 154, 156. The chain wheel 135 is received on the driving hub 111 in a manner that allows a limited amount of relative rotation between the chain wheel 135 and the driving hub 111. The amount of limited rotation is determined by the relative positioning of the key 161 and fingers 154, 156 and the spring tangs 153 there between. The driving hub 111 is rotatably journalled on the chain cover by means of a ball bearing 137 encased between opposite complementary runways 136, 138. A looped driving chain (deleted for clarity from FIG. 13, but shown in FIGS. 14, 15) can engage the chain wheel 135 for inducing rotation to the driving hub 111. The looped driving chain 115 (see also FIGS. 14 and 15) is guided to the exterior of the chain cover 113 by a special chain guide that is composed of two opposite identical chain guide halves 173. These chain guide halves 173 are attached to the chain cover 113 by a front cover 175 and fasteners 177 that engage a back plate 179 through corresponding openings in the front cover 175, chain guide halves 173 and chain cover 113. The remaining parts of the driving member 103 are assembled by a pin 139 engaging through a coil spring 181, a central opening in the chain cover 113, with the stationary connector 117A. The stationary connector 117A will then be in non-rotatable engagement with an inner perimeter surface of protrusion 117B on the chain cover 113. The special chain guide will now be described in reference to FIGS. 14 and 15. The FIGS. 14 and 15 show the chain wheel 135 isolated from the rest of the driving member 103, but with the driving chain 115 and the chain guide halves 173. Each of the chain guide halves 173 as shown in FIG. 14 is composed of a relatively hard wear resistant cover 173B that cooperates with a relatively soft elastomeric base member 173A. The arrangement of a necessary wear resistant surface as a thin cover element 173B over resiliently flexible, elastic base element 173A, successfully reduces noise production of the operated operating chain 115 over the wear resistant surface of the cover 173B. This makes for a low noise chain driving member 103.

Figure 16A:
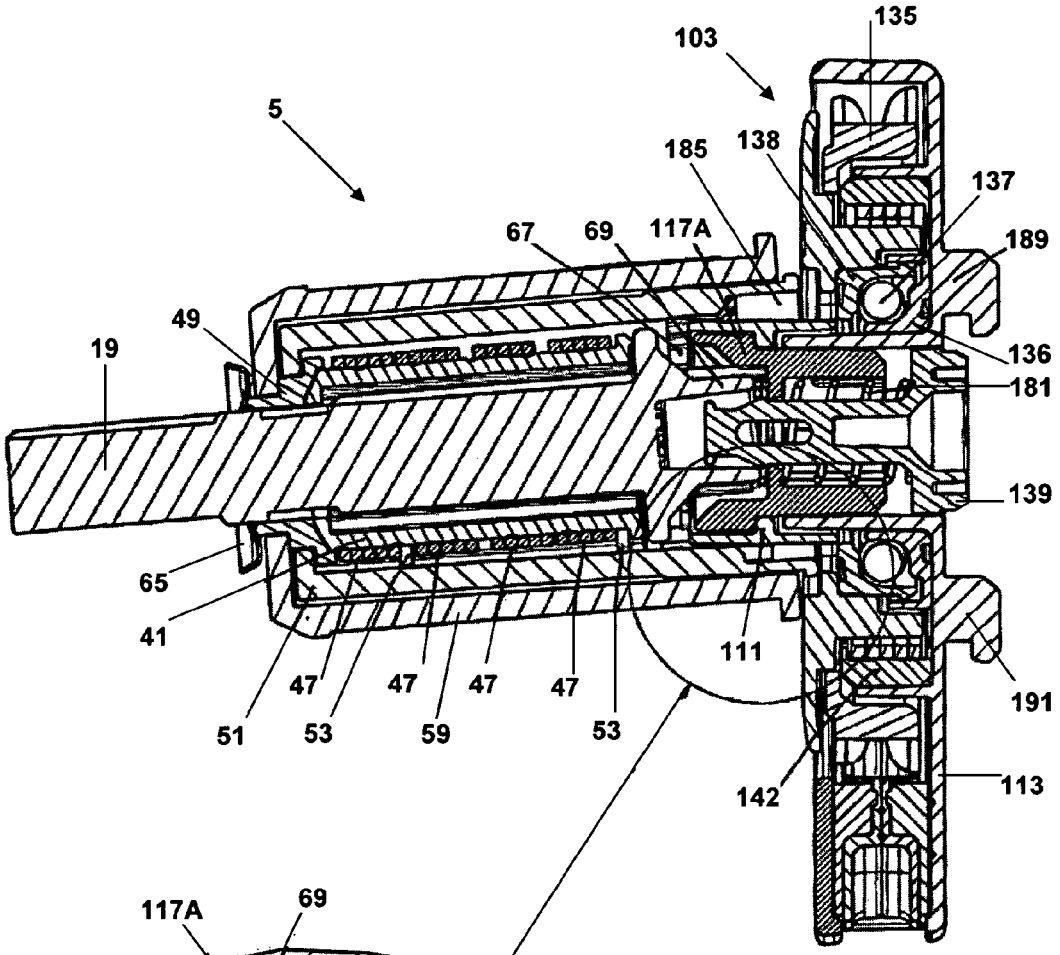
FIGS. 16A and 16B are full and partial cross sections of the driving member showing angular connectivity of the auxiliary shaft brake module.
Figure 16B:
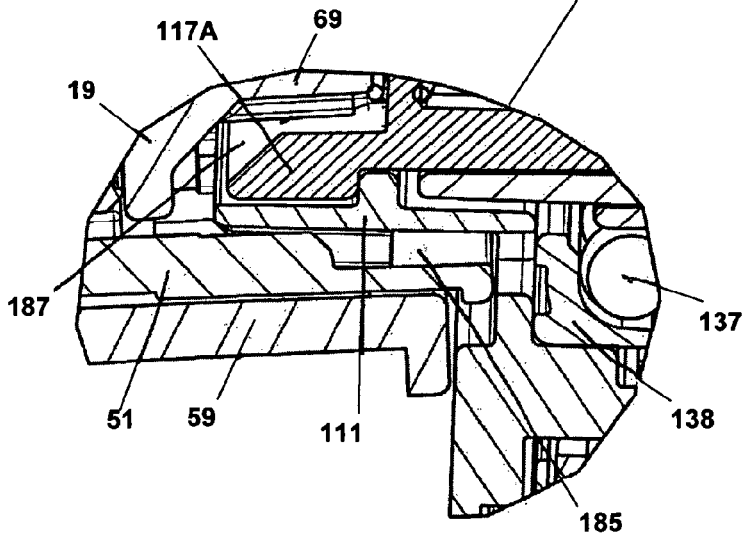

Shown in FIG. 16A is the engagement between the shaft brake module 5 and the driving member 103. This engagement, although it is shown in combination with the second embodiment of driving member 103, is also valid for the first embodiment of FIGS. 1 to 10B. In particular FIG. 16A illustrates that the shaft brake module 5 can engage the driving member 103 from a slightly angular position, which is convenient when maneuvering the winding shaft (deleted from FIGS. 16A to 16B), between opposite mounting brackets. To enable this slight angular position, the outer brake sleeve 51 is provided with an undercut area 185 leading up to its internal splines 67 and guiding these internal splines into engagement with the driving hub 111. Similarly, the stationary connector 117A has a widened area 187, helping the splined end section 69 into engagement with the stationary connector 117A. In FIG. 16B the relevant portion of FIG. 16A is shown on an enlarged scale. The ability of coupling a preassembled winding shaft to a driving member that has been preliminary installed is of particular importance when the winding shaft is combined with a spring assist module. In such assemblies it is particularly beneficial when the pretension or preloading of the spring assist module can be preset at the factory, without having to worry about the final engagement between the winding shaft and the driving member. Only when there is used a chain stopper (see, e.g., chain stopper 16 in FIG. 4) within the operating chain loop, there needs to be the additional instruction to first operate the driving member without the winding shaft engaged, until it is in the fully raised position. Without an end stopper the winding shaft can be engaged in any position of the driving member. Only when removing and reinstalling the winding shaft during use it will be important to take account of the position of retraction or extension in which the winding shaft is removed. Otherwise the original amount of spring assist may not be properly re-established.

Additionally visible in FIG. 16A is that the chain cover 113 on its reverse side is provided with hooks 189, 191 for connecting the driving member 103 to a mounting bracket (not shown, but conventional). The connector pin 139 is resiliently urged to an extended position by the coil spring 181, so that it may latch and retain the chain cover 113 to the bracket (not shown, but conventional) once the hooks 189, 191 have engaged this bracket.

Figure 17:
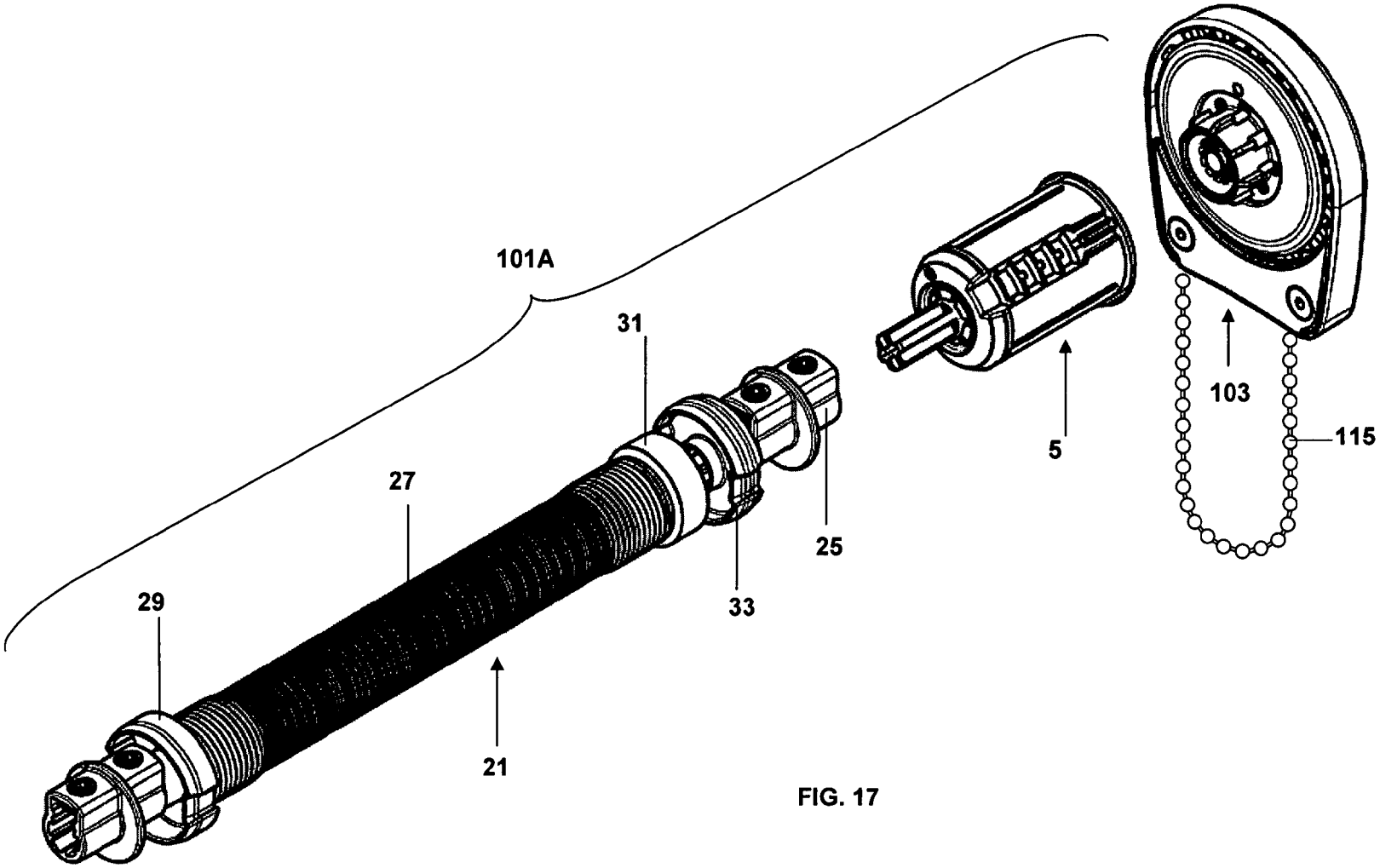
FIG. 17 is an exploded view similar to FIG. 2 of the second embodiment.
Figure 18:
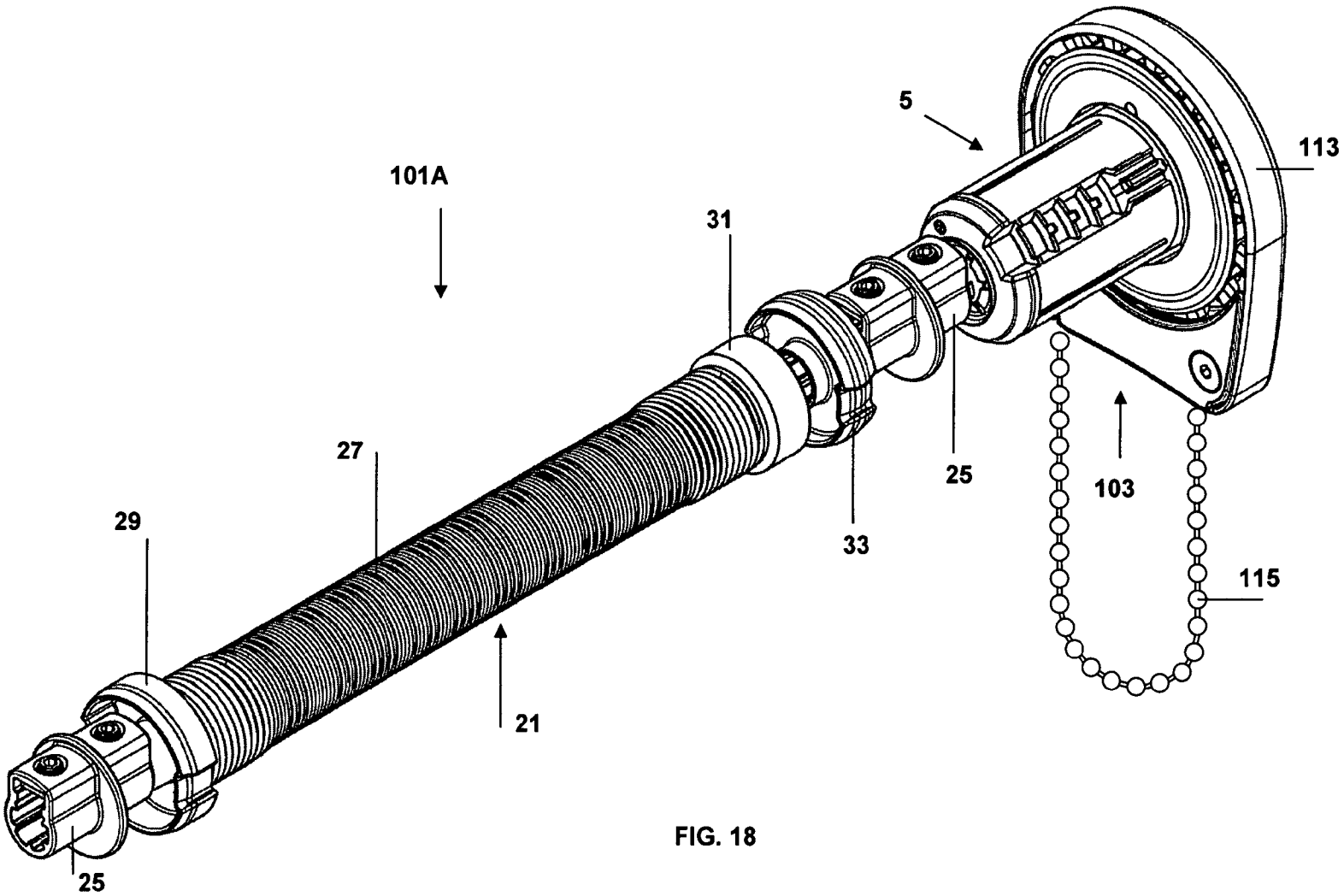
FIG. 18 is an assembled situation of the components shown in FIG. 17.
Figure 19:
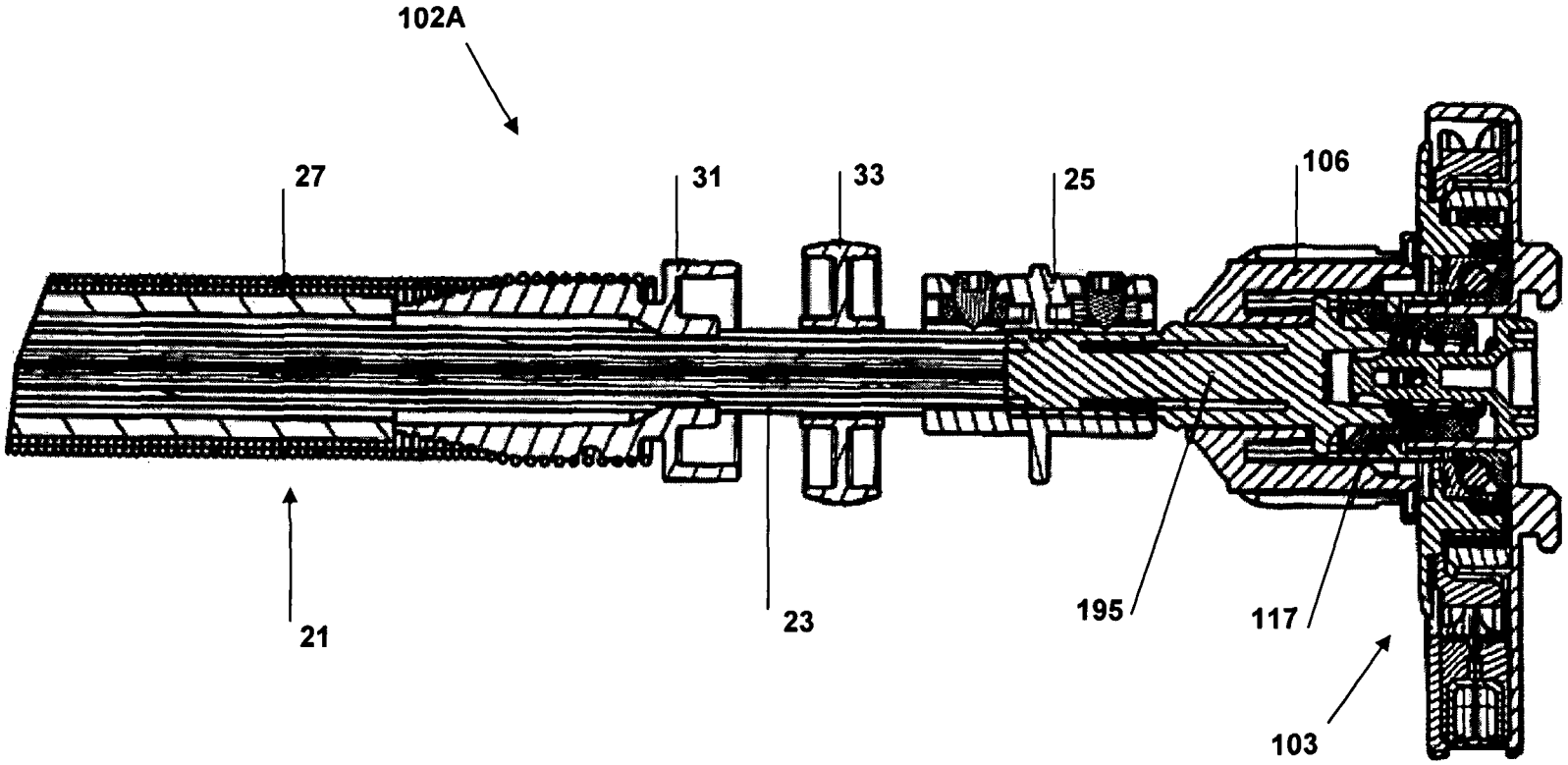
FIG. 19 is a longitudinal cross section of the second embodiment, without auxiliary shaft brake module, but with a spring assist module.

FIGS. 17 and 18 show in both exploded and assembled forms a winding shaft drive 101A with again the optional addition of a spring assist module 21. For further details about the spring assist module 21 reference can be had to the description of FIGS. 2 and 3 and to applicant's published international patent application WO 2010/089118. One particular advantage of the combination of a shaft brake module 5 and a spring assist module 21 according to the embodiment of FIGS. 2 and 3 and of FIGS. 17 and 18, is that the spring assist module 21 can be pretensioned in the winding shaft through the shaft brake module 5. The shaft brake module 5 will then keep the spring assist module 21 in its pretensioned condition, while it is disconnected from the driving member 103. The pretensioning of the spring assist module 21 can conveniently be performed at the assembly plant, so that is needs no adjustment from the end user. The assisting force of the pretensioned spring assist module 21 will thereby only act on the winding shaft during rotation thereof by the driving member 3, 103. Once adjusted to a new position of retraction or extension, the weight of the winding covering that will be associated with the winding shaft drives 1A, 101A will be held by the shaft brake module 5.

In FIG. 19 another variation 102A of the second embodiment is shown in cross section. The variation of winding shaft drive 102A is somewhat similar to that of FIG. 12, but benefits from the addition of a spring assist module. To couple the connector sleeve 25 of the spring assist module 21 to the stationary connector 117 of the driving member 103, an additional connecting shaft 195 may be provided. The connecting shaft 195 extends through the central opening 108 of the standard adapter 106 as shown in FIG. 12. This arrangement is useful when spring assistance is desired for a particular window covering, that is to be operated by the winding shaft drive 102A, but when the shaft brake integrated in the driving member 103 is still sufficient for holding it in position.

Accordingly is described a winding shaft drive 1, 1A, 101, 101A, 102, 102A that is arranged for operating a retractable covering for an architectural opening. This winding shaft drive includes an at least partially hollow winding shaft 7, a driving member 3, 103 for inducing rotation to the winding shaft, and a shaft brake adapted to be operated by the driving member. The shaft brake as described includes a preassembled module 5 for accommodation in the at least partially hollow winding shaft 7 and has first coupling means 67 on one axial end thereof for transmitting rotating forces and second coupling means 69 on the same one axial end for transmitting non-rotating stationary forces. The driving member as further described has a driving hub 11, 111 for disconnectably coupling to the first coupling means 67 and a stationary connector 17, 17A, 117, 117A for disconnectably coupling to the second coupling means 69. Further a shaft brake module 5 and a driving member 3, 103 have been described that are specifically adapted for use in this winding shaft drive.

It is thus believed that the operation and construction of the present invention will be apparent from the foregoing description. The invention is not limited to any embodiment herein described and, within the purview of the skilled person; modifications are possible which should be considered within the scope of the appended claims. Equally all kinematic inversions are considered inherently disclosed and to be within the scope of the present invention. In the claims, any reference signs shall not be construed as limiting the claim. The term 'comprising' when used in this description or the appended claims should not be construed in an exclusive or exhaustive sense but rather in an inclusive sense. Thus the expression 'comprising' as used herein does not exclude the presence of other elements or steps in addition to those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. Winding shaft drive for operating a retractable covering for an architectural opening, the winding shaft drive comprising:

an at least partially hollow winding shaft;

a driving member for inducing rotation to the winding shaft; and a shaft brake adapted to be operated by the driving member;

wherein:

the shaft brake includes a preassembled module for accommodation in the at least partially hollow winding shaft and having a first coupling on one axial end thereof for transmitting rotative forces and a second coupling on the same one axial end for transmitting non-rotative stationary forces;

the driving member has a driving hub for removably coupling to the first coupling and a stationary connector for removably coupling to the second coupling;

the first coupling includes internal splines for coupling with external corresponding splines on the driving hub; and the second coupling includes a splined end section for coupling with corresponding splines on the stationary connector.

2. Winding shaft drive according to claim 1, wherein:

the shaft brake module has a stationary shaft associated with the second coupling; and an end of the stationary shaft is exposed at an end of the shaft brake module opposite of the second coupling and adapted to be coupled to a connector sleeve of a spring assist module.

3. Winding shaft drive according to claim 1 or 2, further comprising a spring assist module.

4. Winding shaft drive according to claim 1 or 2, wherein the shaft brake module includes any one of a selected number of wrap springs acting as a braking element.

5. Winding shaft drive according to claim 4, wherein:

the shaft brake module includes an inner brake sleeve for frictional engagement by the or each wrap spring; and the inner brake sleeve has a lubrication groove helically wound about an outer friction surface thereof.

6. Winding shaft drive according to claim 1, wherein the shaft brake module and the driving member can be coupled to one another in a plurality of relative rotational positions by predefined increments.

7. Winding shaft drive according to claim 6, wherein the splined end section of the second coupling is on a stationary center shaft.

8. Winding shaft drive according to claim 1, wherein the first coupling has an undercut area at an axial end adapted to face the driving hub, to allow the winding shaft to engage the driving member at an angle with respect to an aligned position in which it is finally mounted.

9. Winding shaft drive according to claim 1, wherein the stationary connector has a widened area for receiving the second coupling at an angle with respect to an aligned position in which it is finally mounted.

10. Winding shaft drive according to claim 1, wherein the driving member also has an integral shaft brake.

11. Winding shaft drive according to claim 10, wherein the integral shaft brake includes a wrap spring holder ring.

12. Winding shaft drive according to claim 11, wherein the wrap spring holder ring has inwardly directed rims on each of its axial end faces.

13. Winding shaft drive according to claim 1, wherein the driving member includes a ball bearing interposed between a housing and the driving hub.

14. Winding shaft drive according to claim 1, wherein the driving member includes a chain wheel and an operating chain.

15. Winding shaft drive according to claim 14, wherein the operating chain includes a chain stopper for defining an end of travel for the driving chain and adapted to define one of a fully retracted or fully extended positions of the winding shaft.

16. Winding shaft drive according to claim 14 or 15, wherein:

the operating chain is guided over a chain guide surface;

the chain guide surface is of a relatively hard and wear resistant material; and the chain guide surface is relatively thin and supported on a relatively soft and resiliently flexible material for noise reduction.

17. Winding shaft drive according to claim 1, wherein:

the driving member further comprises a bracket for securing the driving member and the retractable covering to a support structure; and repositioning the shaft brake relative to the driving member repositions the shaft brake relative to the bracket.

18. Winding shaft drive for operating a retractable covering for an architectural opening, the winding shaft drive comprising:

an at least partially hollow winding shaft;

a driving member for inducing rotation to the winding shaft; and a shaft brake adapted to be operated by the driving member;

wherein:

the shaft brake comprises a preassembled brake module for accommodation in the at least partially hollow winding shaft, the preassembled brake module including a first coupling component on one axial end thereof for transmitting rotative forces and a second coupling component on the one axial end for transmitting non-rotative stationary forces;

the driving member is separate from the preassembled brake module, the driving member including a driving hub for removably coupling to the first coupling component of the preassembled brake module and a stationary connector for removably coupling to the second coupling component of the preassembled brake module;

the first coupling component includes internal splines for coupling with external corresponding splines on the driving hub; and the second coupling component of the preassembled brake module includes a stationary center shaft for coupling with the stationary connector of the driving member.

19. Winding shaft drive according to claim 18, wherein the stationary center shaft of the preassembled brake module includes a splined end section for coupling with corresponding splines on the stationary connector of the driving member.

20. Winding shaft drive according to claim 18, wherein the preassembled brake module further includes an inner sleeve non-rotatably mounted onto the stationary center shaft.

21. Winding shaft drive according to claim 20, wherein the preassembled brake module further includes an outer sleeve at least partially surrounding the inner sleeve and rotatable relative to the inner sleeve.

22. Winding shaft drive according to claim 21, wherein the outer sleeve includes the first coupling component.

23. Winding shaft drive according to claim 21, wherein the preassembled brake module further includes a wrap spring frictionally engaging the inner sleeve and including a radially-extending tang selectively engaging the outer sleeve to loosen the wrap spring from the inner sleeve and allow the wrap spring to rotate with the outer sleeve.

24. Winding shaft drive according to claim 23, wherein the preassembled brake module further includes an outer housing at least partially surrounding the outer sleeve and rotatable relative to the inner sleeve and the outer sleeve.

25. Winding shaft drive according to claim 24, wherein the radially-extending tang of the wrap spring selectively engages the outer housing to tighten the wrap spring around the inner sleeve and restrict movement of the retractable covering.

26. Winding shaft drive according to claim 25, wherein the outer sleeve defines a window through which the radially-extending tang extends to selectively engage the outer housing.

27. Winding shaft drive according to claim 23, wherein the inner sleeve defines a helical groove for lubrication.

28. Winding shaft drive for operating a retractable covering for an architectural opening, the winding shaft drive comprising:

an at least partially hollow winding shaft;

a driving member for inducing rotation to the winding shaft; and a shaft brake adapted to be operated by the driving member;

wherein:

the shaft brake comprises a preassembled brake module for accommodation in the at least partially hollow winding shaft, the preassembled brake module including a first coupling member on one axial end thereof for transmitting rotative forces and a second coupling member on the one axial end for transmitting non-rotative stationary forces;

the driving member is separate from the preassembled brake module, the driving member including a driving hub for removably coupling to the first coupling member of the preassembled brake module and a stationary connector at a center of the driving hub for removably coupling to the second coupling member of the preassembled brake module; and the first coupling member includes internal splines for coupling with external corresponding splines on the driving hub.

29. Winding shaft drive according to claim 28, wherein the second coupling member of the preassembled brake module includes a splined end section for coupling with corresponding splines on the stationary connector of the driving member.

30. Winding shaft drive according to claim 28, wherein the preassembled brake module further includes:

a non-rotatable inner sleeve;

an outer sleeve at least partially surrounding the inner sleeve and rotatable relative to the inner sleeve;

an outer housing at least partially surrounding the outer sleeve and rotatable relative to the inner sleeve and the outer sleeve; and a wrap spring frictionally engaging the inner sleeve and including a radially-extending tang selectively engaging the outer sleeve and the outer housing.

31. Winding shaft drive according to claim 30, wherein the outer sleeve includes the first coupling member.

32. A winding shaft drive for operating a retractable covering for an architectural opening, the winding shaft drive comprising:

an at least partially hollow winding shaft for supporting the covering;

a driving member for extending and retracting the covering, the driving member comprising:

a bracket for securing to a support structure; and a driving hub rotatable relative to the bracket; and a self-contained braking module that is separate from the driving member;

wherein:

the self-contained braking module is selectively connectable to the driving member for securing the driving hub in a position, the self-contained braking module including a first coupling member having internal splines for coupling with external corresponding splines on the driving hub; and the driving member is operational to retract and extend the retractable covering before and after the self-contained braking module is connected to the driving member.

33. Winding shaft drive according to claim 32, wherein:

the first coupling member is on one axial end of the self-contained braking module for transmitting rotative forces; and the self-contained braking module further comprises a second coupling member on the one axial end for transmitting non-rotative stationary forces.

34. Winding shaft drive according to claim 33, wherein:

the driving hub removably couples the driving member to the first coupling member of the self-contained braking module; and the driving member includes a stationary connector at a center of the driving hub for removably coupling to the second coupling member of the self-contained braking module.

35. Winding shaft drive according to claim 34, wherein the second coupling member of the self-contained braking module includes a stationary center shaft having a splined end section for coupling with corresponding splines on the stationary connector of the driving member.

* * * * *